US011794494B2

(12) United States Patent
Takahashi

(10) Patent No.: US 11,794,494 B2
(45) Date of Patent: Oct. 24, 2023

(54) IMAGE FORMING APPARATUS

(71) Applicant: Hiroki Takahashi, Kanagawa (JP)

(72) Inventor: Hiroki Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/513,545

(22) Filed: Oct. 28, 2021

(65) Prior Publication Data

US 2022/0169044 A1 Jun. 2, 2022

(30) Foreign Application Priority Data

Nov. 27, 2020 (JP) ..... 2020-197492

(51) Int. Cl.

| | |
|---|---|
| ***B41J 11/00*** | (2006.01) |
| ***G03G 15/00*** | (2006.01) |
| ***B41J 29/393*** | (2006.01) |
| ***B41J 11/46*** | (2006.01) |

(52) U.S. Cl.

CPC ..... *B41J 11/007* (2013.01); *B41J 11/0095* (2013.01); *B41J 11/46* (2013.01); *B41J 29/393* (2013.01); *G03G 15/5062* (2013.01)

(58) Field of Classification Search

CPC ..... B41J 29/393; B41J 11/46; B41J 11/007; B41J 11/0095; G03G 15/5062

See application file for complete search history.

(56) References Cited

U.S. PATENT DOCUMENTS

| | | | | |
|---|---|---|---|---|
| 2016/0236466 | A1 | 8/2016 | Takahashi et al. | |
| 2017/0165962 | A1 | 6/2017 | Mizutani et al. | |
| 2018/0141329 | A1* | 5/2018 | Aoyagi | B41J 11/46 |
| 2019/0283410 | A1 | 9/2019 | Takahashi | |
| 2019/0283413 | A1 | 9/2019 | Katoh et al. | |
| 2020/0039225 | A1 | 2/2020 | Miura et al. | |
| 2020/0039250 | A1* | 2/2020 | Kizaki | B41J 11/0095 |
| 2021/0122155 | A1 | 4/2021 | Takahashi | |

FOREIGN PATENT DOCUMENTS

| | | | | |
|---|---|---|---|---|
| JP | 2006-240792 | | 9/2006 | |
| JP | 2017-088398 | | 5/2017 | |
| JP | 2017088398 | A * | 5/2017 | B65H 23/192 |
| JP | 2018-069674 | | 5/2018 | |
| JP | 2018-083678 | | 5/2018 | |

OTHER PUBLICATIONS

U.S. Appl. No. 17/239,846, filed Apr. 26, 2021, Hiroki Takahashi.

* cited by examiner

*Primary Examiner* — Jannelle M Lebron
(74) *Attorney, Agent, or Firm* — Duft & Bornsen, PC

(57) ABSTRACT

An image forming apparatus includes a conveyor configured to convey a recording medium based on a prescribed amount of conveyance, an image forming device configured to form an image on the recording medium conveyed by the conveyor, a marker configured to add a plurality of orderly-arrayed marks on the recording medium when the recording medium is conveyed by the conveyor, a detector configured to detect the plurality of orderly-arrayed marks on the recording medium, and circuitry. The circuitry of the image forming apparatus is configured to calculate an amount of movement of the plurality of orderly-arrayed marks detected by the detector, and correct the prescribed amount of conveyance of the recording medium based on the amount of movement.

5 Claims, 9 Drawing Sheets

| NUMBER OF INSTANCES OF CONVEYANCE | 1 | 2 | 3 | 4 | 5 | ... |
|---|---|---|---|---|---|---|
| TARGET VALUE | 100 | | | | | ... |
| AMOUNT OF MOVEMENT | 100 | 90 | 95 | 85 | 80 | ... |
| CALCULATE AVERAGE VALUE | | | | | | |
| AVERAGE ERROR | xx | | 95 | 90 | 90 | ... |
| NEXT AMOUNT OF CONVEYANCE | xx | | 105 | 110 | 110 | ... |

IMAGE FORMING APPARATUS

CROSS-REFERENCE TO RELATED APPLICATION

This patent application is based on and claims priority pursuant to 35 U.S.C. § 119(a) to Japanese Patent Application No. 2020-197492, filed on Nov. 27, 2020, in the Japan Patent Office, the entire disclosure of which is hereby incorporated by reference herein.

BACKGROUND

Technical Field

Embodiments of the present disclosure relate to an image forming apparatus.

Background Art

In the related art, technologies to correct the amount of conveyance before printing is performed by inkjet printers are known in the art. Such technologies are adopted to deal with variations in friction between a recording sheet and a platen or the like, which are caused by the difference in material of a recording sheet on the rear side. For example, technologies are known in the art in which an image of the patterns of fiber on, for example, a recording sheet is captured several times by a camera and pattern matching is performed on the captured images at prescribed time intervals. As a result, the amount of movement of the recording sheet can be obtained.

Moreover, technologies are known in the art in which an image of patterns on print media is captured to obtain the amount of movement of the print media. In such technologies known in the art, an image of patterns on a print medium is captured with a high-precision camera, and pattern matching is performed on the obtained patterns. As a result, the amount of movement can be detected.

SUMMARY

Embodiments of the present disclosure described herein provide an image forming apparatus including a conveyor configured to convey a recording medium based on a prescribed amount of conveyance, an image forming device configured to form an image on the recording medium conveyed by the conveyor, a marker configured to add a plurality of orderly-arrayed marks on the recording medium when the recording medium is conveyed by the conveyor, a detector configured to detect the plurality of orderly-arrayed marks on the recording medium, and circuitry. The circuitry of the image forming apparatus is configured to calculate an amount of movement of the plurality of orderly-arrayed marks detected by the detector, and correct the prescribed amount of conveyance of the recording medium based on the amount of movement.

BRIEF DESCRIPTION OF THE DRAWINGS

A more complete appreciation of embodiments and the many attendant advantages thereof will be readily obtained as the same becomes better understood by reference to the following detailed description when considered in connection with the accompanying drawings.

Figure 1:
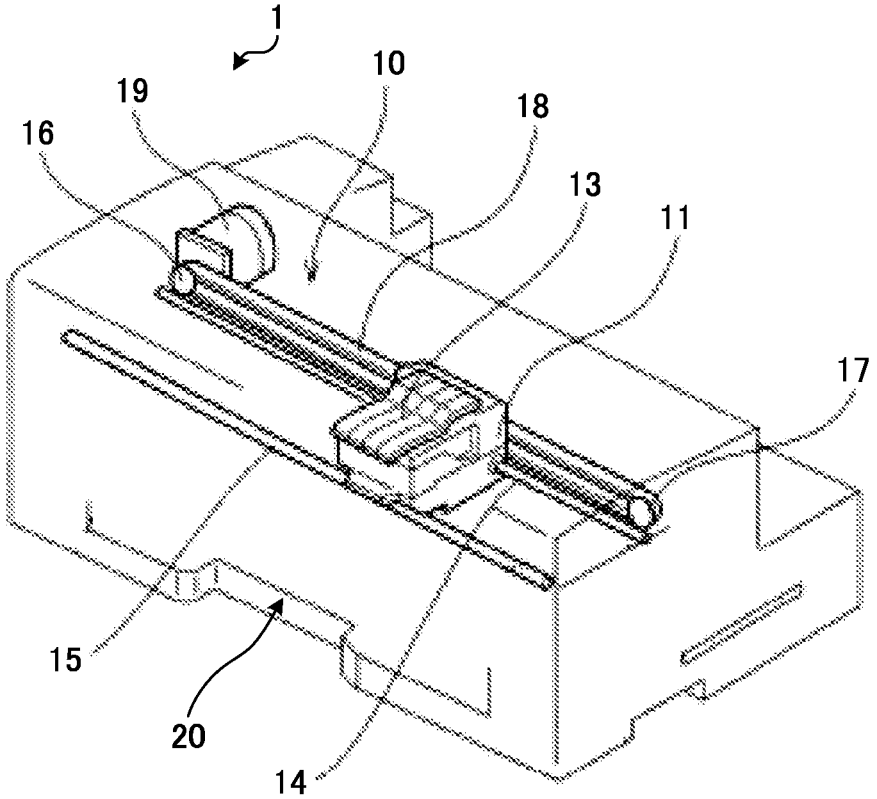
FIG. 1 is an external perspective view of an inkjet recording apparatus that serves as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

An image forming apparatus according to an embodiment of the present disclosure is described below in detail with reference to the accompanying drawings. The image forming apparatus according to the present embodiment that is applied to an inkjet recording apparatus is described below.

FIG. 1 is an external perspective view of an inkjet recording apparatus such as a wide format printer that serves as an image forming apparatus according to an embodiment of the present disclosure.

In FIG. 1, a portion of the internal structure of scenography inkjet recording apparatus is illustrated in a fluoroscopic manner.

Figure 2:
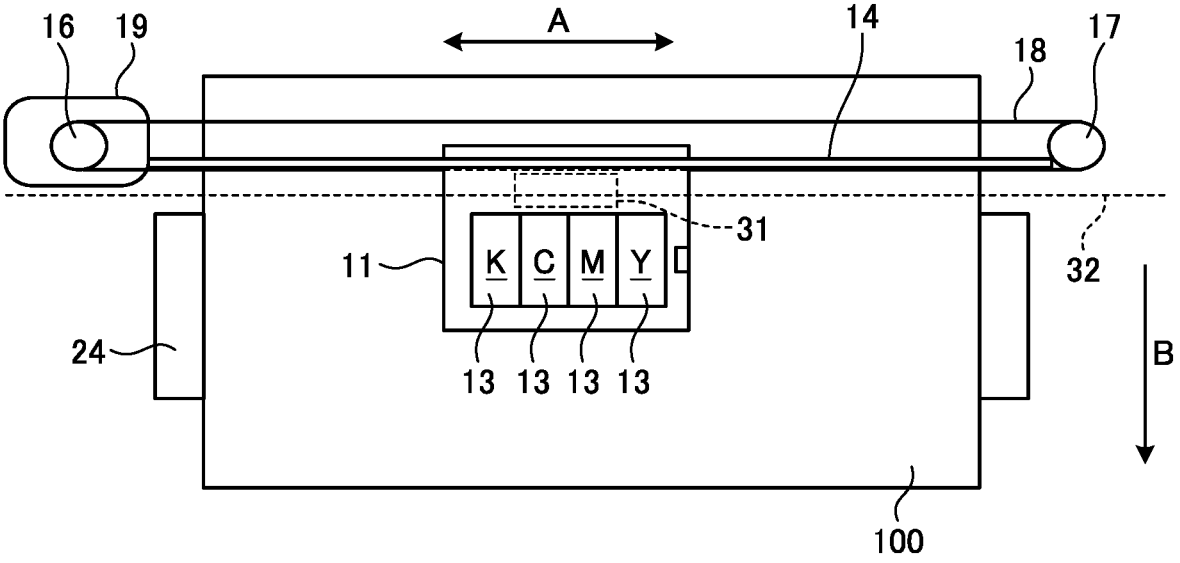
FIG. 2 is a plan view of the internal structure of an inkjet recording apparatus according to an embodiment of the present disclosure.

FIG. 2 is a plan view of the internal structure of the inkjet recording apparatus according to the present embodiment.

Figure 3:
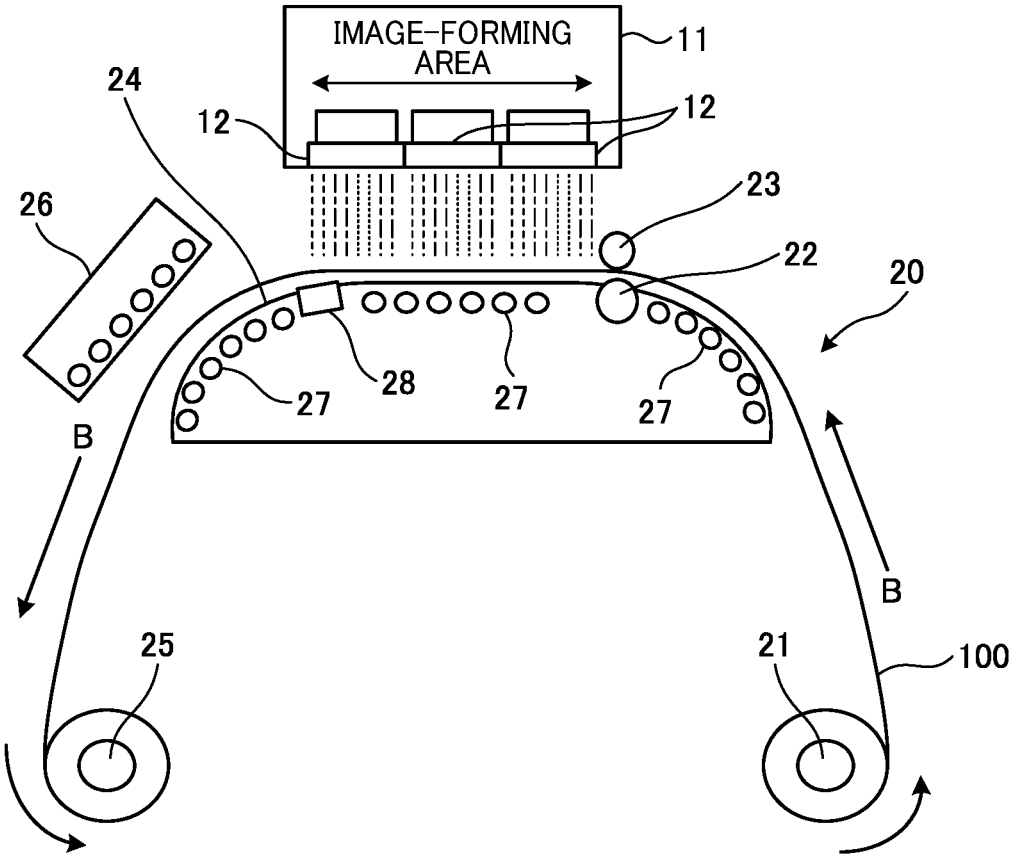
FIG. 3 is a side view of the internal structure of an inkjet recording apparatus according to an embodiment of the present disclosure.

FIG. 3 is a side view of the internal structure of the inkjet recording apparatus according to the present embodiment.

In FIG. 3, some of the internal structure of the conveyor that is hidden in the plan view of FIG. 2 is schematically illustrated. Firstly, a configuration or structure of the inkjet recording apparatus that serves as the image forming apparatus according to an embodiment of the present disclosure will be described with reference to FIG. 1 to FIG. 3.

The inkjet recording apparatus 1 according to the present embodiment includes, in an upper portion of the body of the inkjet recording apparatus 1, a carriage 11, a discharge head 12 mounted on the carriage 11, an ink cartridge 13 that supplies ink of each color to the discharge head 12, and a driver 10 that drives the carriage 11 in a direction A. These elements correspond to an image forming device. However, no limitation is intended thereby, and any unit or device may be included in the image forming device as long as it can form an image on a recording medium.

At a lower portion of the body of the inkjet recording apparatus 1 according to the present embodiment, a conveyor 20 is arranged that intermittently conveys the recording medium set on a portion provided with a roller in a direction B. Such a recording medium is, for example, a long recording sheet 100.

The driver 10 according to the present embodiment includes a main guide rod 14 and a sub-guide rod 15 that serve as a set of guide units that are laterally bridged on the right and left side plates of the body of the inkjet recording apparatus 1, and uses these units including the main guide rod 14 and the sub-guide rod 15 to hold the carriage 11 in a slidable manner in the direction A.

The carriage 11 according to the present embodiment is fixed to a timing belt 18 stretched between a driving pulley 16 and a driven pulley 17, and drives the driving pulley 16 under the control of a main-scanning motor 19 to move the carriage 11 in the direction A.

The carriage 11 includes an encoder sensor 31, and the encoder sensor 31 scans and reads an encoder sheet 32 that is arranged in the moving direction (direction A) of the carriage 11 and serves as a linear scale. As a result, the position of the carriage 11 is detected.

In the present embodiment, ink of each color is supplied from each one of the ink cartridges 13 of yellow (Y), magenta (M), cyan (C), and black (BK), and ink droplets of each color are ejected from the ejection-nozzle rows of the discharge head 12.

The recording sheet 100 is fed out from the portion provided with a roller on the rear side of the body of the inkjet recording apparatus 1, by the rotation of a sheet feeder unit 21 that includes a motor and an encoder sensor. The fed recording sheet 100 is sandwiched between the registration roller 22 and the pinch roller 23 that serve as a roller pair, and is sent in the direction B along the peripheral surface of the platen 24. Then, the recording sheet 100 is wound around the core of a sheet ejection unit 25, and is collected. In the present embodiment, the registration roller 22 is driven to rotate intermittently. In so doing, the pinch roller 23 presses the recording sheet 100 against the registration roller 22, and the recording sheet 100 contacts the curved surface of the registration roller 22 without interruption in response to the pressing force. As a result, the force of the registration roller 22 is appropriately conveyed to the recording sheet 100, and the tension on the recording sheet 100 between the sheet feeder unit 21 and the registration roller 22 is kept constant during the rotation.

When the registration roller 22 is intermittently operated, the recording sheet 100 is intermittently fed to an output tray in specified quantity.

The platen 24 according to the present embodiment is provided with a suction unit for preventing the recording sheet 100 from floating. In the present embodiment, a large number of small suction holes are arranged, and the recording sheet 100 is sucked and adhered to the outer circumferential surface of the platen 24 by the rotation of a fan to prevent floating. Further, the platen 24 is provided with heaters such as a curing heater 26 and a plurality of post heaters 27. The ink that is dropped on the recording sheet 100 is cured by these heaters to fix the image.

The discharge head 12 ejects ink of each color from the ejection surface of the discharge head 12 as illustrated in FIG. 3 to form an image in an image-forming area. A plurality of rows of ejection nozzles are arranged in the direction A, i.e., the main scanning direction, on the ejection surface of the discharge head 12. In the present embodiment as illustrated in FIG. 3, three sets of ejection-nozzle rows for yellow (Y), magenta (M), cyan (C), and black (BK) are arranged for each color.

The platen 24 is heated in advance by the post heaters 27, and the ink that is ejected from the ejection surface of the discharge head 12 is cured immediately after the ink adheres to the recording sheet 100.

The discharge head 12 forms an image on the recording sheet 100 in the main scanning direction as the driver 10 drives the carriage 11 to reciprocate in the direction A. When the image formation in the main scanning direction is completed, the conveyor 20 conveys a predetermined amount of the recording sheet 100 in the direction B. Then, the discharge head 12 forms an image on the recording sheet 100 in the main scanning direction as the driver 10 drives the carriage 11 again to reciprocate in the direction A. As described above, the inkjet recording apparatus 1 according to the present embodiment uses the discharge head 12 to form an image in the main scanning direction, and uses the conveyor 20 to convey the recording sheet 100 in the sub-scanning direction. As these processes are repeated, an image is formed on the recording sheet 100.

The inkjet recording apparatus 1 according to the present embodiment is configured to detect the amount of movement or feeding of the recording sheet 100. In order to implement such a configuration, the inkjet recording apparatus 1 according to the present embodiment is provided with a detector used to detect the mark on the recording sheet 100 and a marker used to add a plurality of marks on the recording sheet 100 at even intervals when the recording sheet 100 is conveyed by a conveyor 20. The registration roller 22 as illustrated in FIG. 3 is provided with a spike marker, which forms spike marks on the recording sheet 100, as the above marker. The sensor 28 provided for the platen 24 corresponds to the above detector, and detects the amount of movement of the recording sheet 100 based on the spike marks on the recording sheet 100.

Figure 4A:
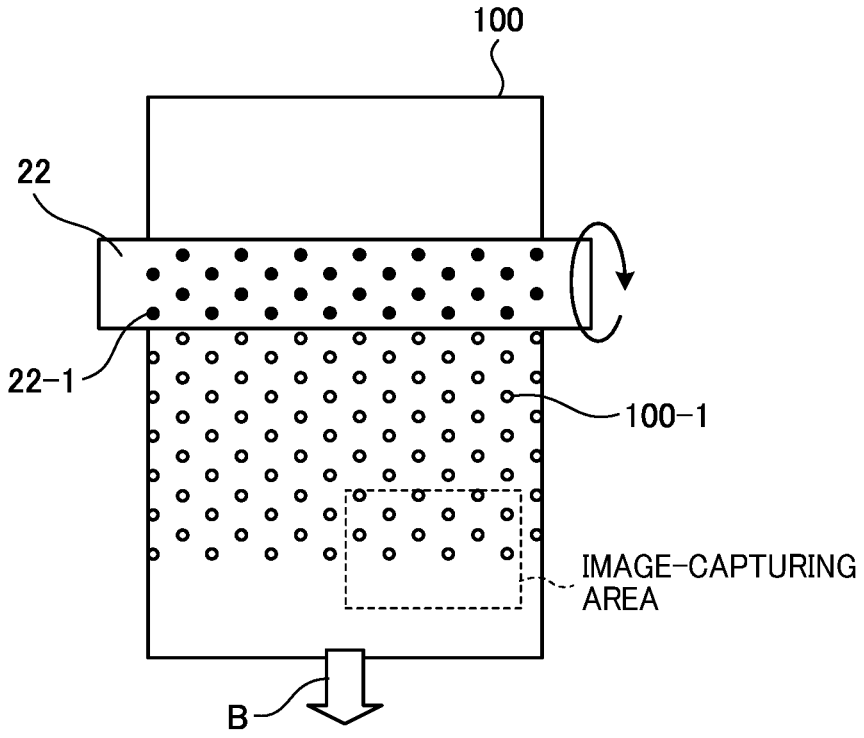
FIG. 4A and FIG. 4B are diagrams illustrating a marker according to an embodiment of the present disclosure.
Figure 4B:
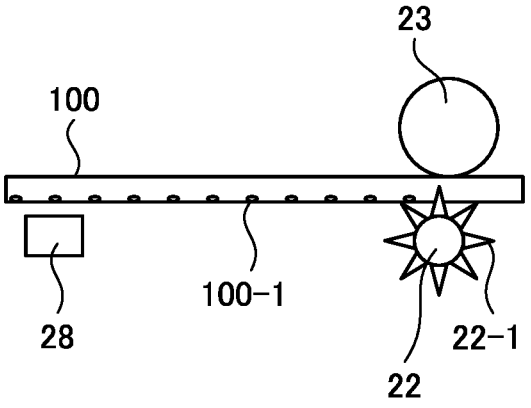

FIG. 4A and FIG. 4B are diagrams illustrating a marker according to the present embodiment.

In the present embodiment as illustrated in FIG. 4A and FIG. 4B, spike marks are formed on the recording sheet 100 by means of the spike markers arranged on the registration roller 22. As illustrated in FIG. 4A and FIG. 4B, a plurality of protrusions are arranged at equal distances in the circumferential direction of the curved surface of the registration roller 22. In other words, a plurality of protrusions are arranged at equal distances in the circumferential direction of the curved surface that contacts the recording sheet 100. A plurality of protrusions are arranged at predetermined pitches in a direction orthogonal to the circumferential direction. Such a direction orthogonal to the circumferential direction may be referred to as a lateral direction in the following description. In the present embodiment, a large number of spikes 22-1 are orderly arrayed on the registration roller 22. When the registration roller 22 rotates in the direction indicated by an arrow that indicates rotation, the recording sheet 100 is conveyed toward the output tray in the direction B. Then, the multiple spikes 22-1 hit the rear side of the recording sheet 100 at equal distances according to the amount of movement of the recording sheet 100 to form orderly spike marks 100-1 on the rear side of the recording sheet 100.

A predetermined image-capturing area that is set by the sensor 28 provided for the platen 24 is scanned and read from the spike marks 100-1 formed on the rear side of the recording sheet 100. FIG. 4A illustrates an image-capturing area of the sensor 28, according to the present embodiment. Firstly, the sensor 28 according to the present embodiment uses an imaging device such as a charge coupled device (CCD) sensor to capture an image in an image-capturing area indicated by a rectangular frame drawn with dotted lines as in FIG. 4A. Then, the sensor 28 recognizes a plurality of captured spike marks 100-1 as marks, and computes and obtains the amount of movement based on orderly patterns of the marks. Finally, a feedback is sent to a control unit 40 as will be described later in detail. For example, the sensor 28 tracks the same spike marks 100-1 in the image-capturing area both prior to and subsequent to the conveyance of the recording sheet 100, and computes the amount of movement based on the spacing between an adjacent pair of the spike marks 100-1. Finally, a feedback is sent to the control unit 40 (see FIG. 5).

As described above, when the multiple spikes 22-1 are arranged on the registration roller 22, the multiple spikes 22-1 hit the rear side of the recording sheet 100. Accordingly, the recording sheet 100 can be conveyed without slipping. In the present embodiment, the multiple spikes 22-1 are small protrusions that do not affect the front side of the recording sheet 100, and spike marks 100-1 are formed only on the rear side of the recording sheet 100.

Figure 5:
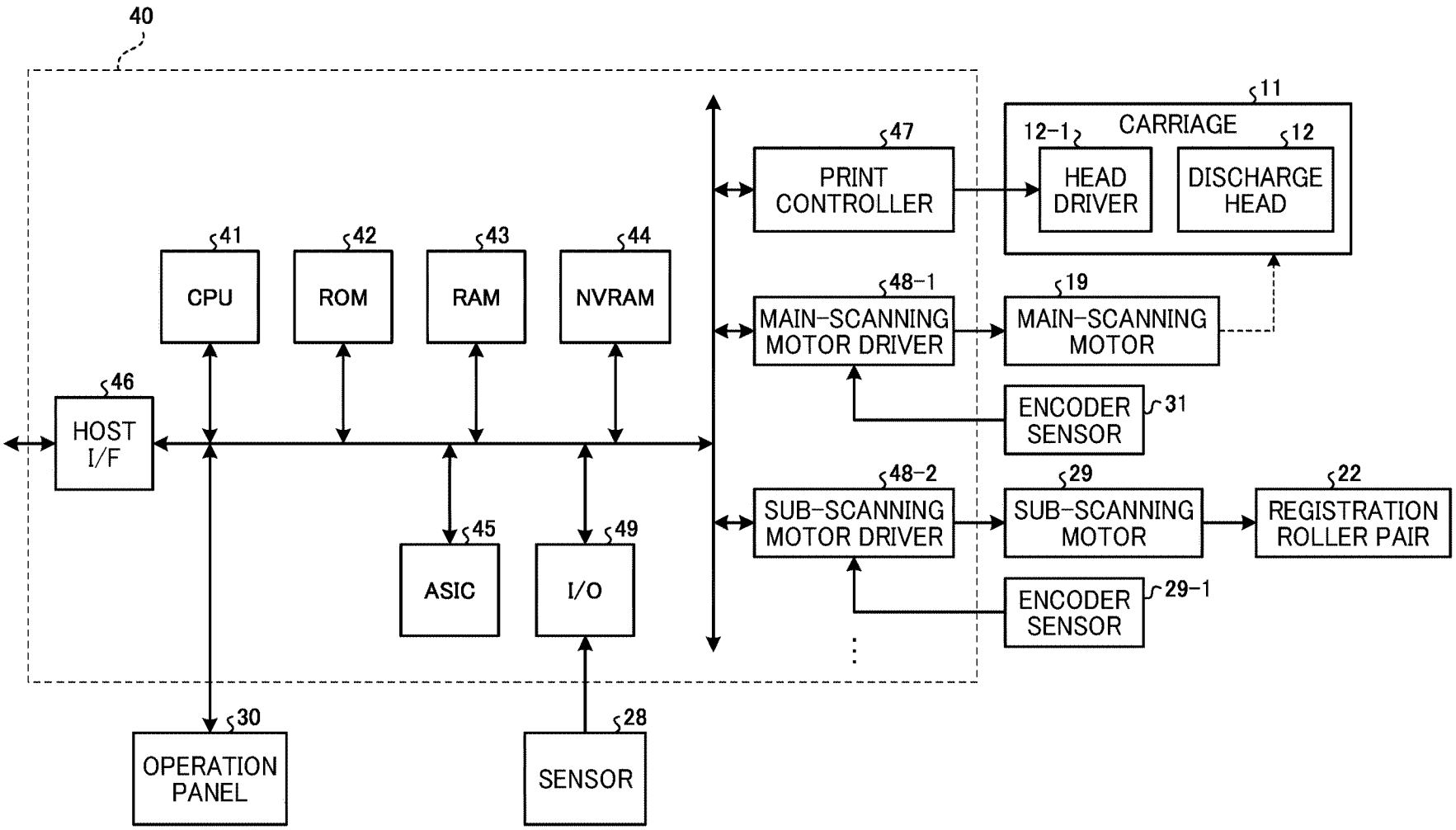
FIG. 5 is a diagram illustrating a configuration of control blocks of an inkjet recording apparatus, according to an embodiment of the present disclosure.

FIG. 5 is a diagram illustrating a configuration of control blocks of the inkjet recording apparatus 1, according to the present embodiment.

The control unit 40 as illustrated in FIG. 5 includes, for example, a central processing unit (CPU) 41, a read only memory (ROM) 42, a random access memory (RAM) 43, a non-volatile random access memory (NVRAM) 44, and an application-specific integrated circuit (ASIC) 45.

The CPU 41 according to the present embodiment controls the entirety of the inkjet recording apparatus 1. The ROM 42 stores control programs and various kinds of data. The RAM 43 is used as, for example, a work area of the CPU 41. The NVRAM 44 also retains the data even when the power source for the inkjet recording apparatus 1 is cut out. The ASIC 45 performs, for example, image processing operations.

The control unit 40 includes a host interface (I/F) 46 used to exchange data or signals with a host device. The host interface 46 according to the present embodiment receives the print data sent from the host device through a cable or a network such as the local area network (LAN).

The print controller 47 according to the present embodiment includes a data transmitter that controlling the operation of the discharge head 12 and a drive waveform generation unit that generates a drive waveform. The carriage 11 includes a head driver 12-1 that is a driver integrated circuit (IC) to drive the discharge head 12.

The main-scanning motor driver 48-1 according to the present embodiment drives the main-scanning motor 19 based on a speed detection value, a position detection value, a speed target value, and a position target value. The speed detection value and the position detection value are obtained as a result of sampling performed on the pulses detected by the encoder sensor 31 that makes up a linear encoder, and the speed target value and the position target value are obtained from a speed and position profile stored in advance.

The sub-scanning motor driver 48-2 according to the present embodiment drives the sub-scanning motor 29 based on a speed detection value, a position detection, a speed target value, and a position target value. The speed detection value and the position detection value are obtained as a result of performing sampling on the pulses detected by an encoder sensor 29-1 that makes up a rotary encoder, and the speed target value and the position target value are obtained from the speed and position profile stored in advance.

The sensor 28 is an imaging sensor such as a charge coupled device (CCD), and outputs the detection data, i.e., the captured image data, to an input and output (I/O) 49.

Moreover, the control unit 40 according to the present embodiment is coupled to an operation panel 30 or the like, which is used to input and display necessary information, in such a manner that the control unit 40 and the operation panel 30 or the like can communicate with each other, or the controller 40 according to the present embodiment may be provided with, for example, a heater controller and a temperature sensor used to detect the degree of temperature.

The CPU 41 according to the present embodiment reads and analyzes the received print data, and causes the ASIC 45 to perform, for example, image processing and data sorting as desired. Moreover, the CPU 41 instructs the print controller 47 to print an image based on the image data.

Figures 6, 7:
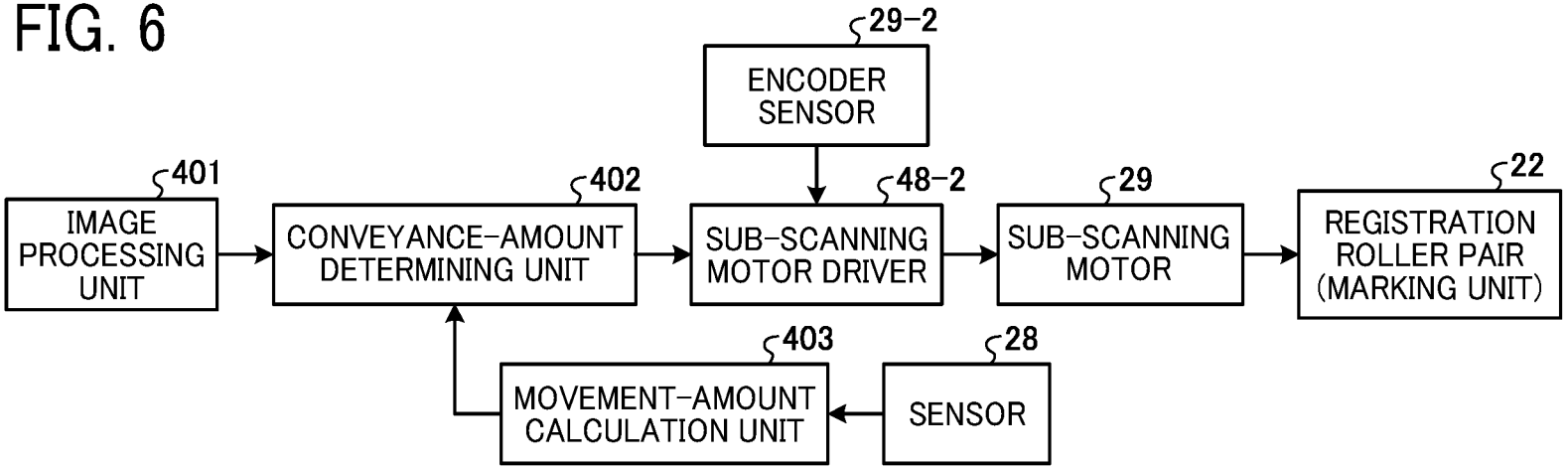
FIG. 6 is a diagram illustrating a configuration of control blocks of a sub-scanning motor driver in a concrete manner, according to an embodiment of the present disclosure.
FIG. 7 is a diagram illustrating the results of calculation in which the several amounts of conveyance or the several amounts of movement are averaged to calculate the amount of conveyance, according to an embodiment of the present disclosure.

FIG. 6 is a diagram illustrating a configuration of control blocks of the sub-scanning motor driver 48-2 in a concrete manner, according to the present embodiment.

In the control blocks as illustrated in FIG. 6, a conveyance-amount determining unit 402 corresponds to a corrector, and a movement-amount calculation unit 403 corresponds to a calculator. In the control blocks illustrated in FIG. 6, an image processing unit 401, the conveyance-amount determining unit 402, and the movement-amount calculation unit 403 may be configured by hardware such as an ASIC, or may be functionally implemented by a control program that is executed by the CPU 41. Alternatively, only some of the above elements of the control blocks may be functionally implemented. Like reference signs are given to elements similar to those illustrated in FIG. 5.

In the present embodiment, it is assumed that the registration roller 22 is rotated to convey the recording sheet 100 and the spike marks 100-1 are formed at the scanning position in the margin of the recording sheet 100 before an image is formed. As a result, spike marks can be scanned at a scanning position of the sensor 28.

The image processing unit 401 according to the present embodiment outputs the amount of conveyance obtained by, for example, the analysis of the print data to the conveyance-amount determining unit 402. The amount of conveyance indicates how much the recording sheet 100 is conveyed in the sub-scanning direction due to the intermittent operation performed by the conveyor 20 one time.

The conveyance-amount determining unit 402 according to the present embodiment corrects the amount of conveyance input from the image processing unit 401 in accordance with the actual amount of movement calculated by the movement-amount calculation unit 403, and outputs the amount of conveyance determined by the correction to the sub-scanning motor driver 48-2. As a result, the sub-scanning motor 29 is driven to rotate in a desired amount. For example, the conveyance-amount determining unit 402 determines the amount of conveyance based on a first equation given below.

Previous amount of conveyance+(Desired amount of conveyance−Amount of movement of recording medium)=Next amount of conveyance First Equation For example, when the previous amount of conveyance, the desired amount of conveyance, and the amount of movement of the recording medium are 100 micrometers (μm), 90 μm, and 80 μm, respectively, these values are applied to the above first equation to obtain the amount of conveyance as given below.

100 μm+(90 μm−80 μm)=110 μm

In the present embodiment, the amount of movement of the recording medium indicates the amount of movement of the recording sheet 100.

The above first equation is given as an example, and no limitation is indicated thereby. For example, control may be performed such that the amount of conveyance will be corrected when the result of calculation in "Desired amount of conveyance−Amount of movement of recording medium" is equal to or greater than a certain value. In other words, in such an alternative embodiment of the present disclosure, the error in the amount of conveyance is not corrected until a certain number of errors occur in a target amount of conveyance, and the amount of conveyance is corrected at once when the certain number of errors occur. Alternatively, the several amounts of conveyance or the several amounts of movement may be averaged to calculate the amount of conveyance.

FIG. 7 is a diagram illustrating results of calculation in which the several amounts of conveyance or the several amounts of movement are averaged to calculate the amount of conveyance, according to the present embodiment.

In the example illustrated in FIG. 7, an average value of the three amounts of movement including the previous two amounts of movement is calculated, and the next amount of conveyance is calculated based on a difference (error) between the previously-obtained average of the three amounts of movement and the currently-obtained average of the three amounts of movements. As described above, the several amounts of conveyance or the several amounts of movement may be averaged to calculate the amount of conveyance.

As described above, the conveyance-amount determining unit 402 corrects the amount of conveyance based on the actual amount of movement calculated by the movement-amount calculation unit 403, and outputs the corrected amount of conveyance to the sub-scanning motor driver 48-2. How the movement-amount calculation unit 403 calculates the amount of movement will be described later in detail.

Figure 8:
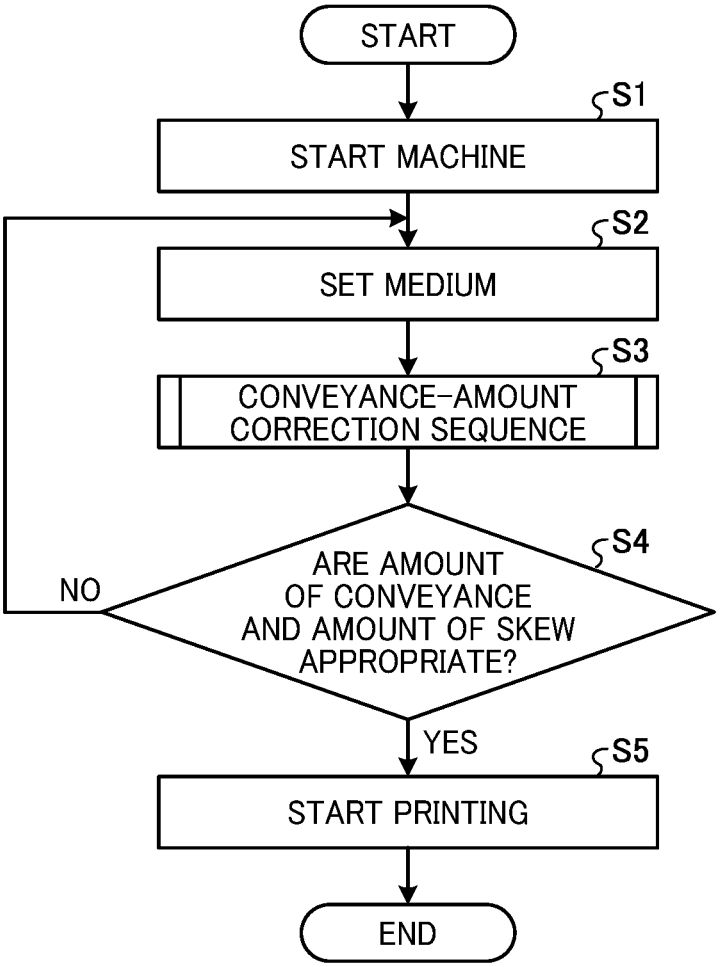
FIG. 8 is a flowchart of the controlling processes performed by an inkjet recording apparatus, according to an embodiment of the present disclosure.

FIG. 8 is a flowchart of the controlling processes performed by the control unit 40 of the inkjet recording apparatus 1, according to the present embodiment.

Firstly, in a step S1, the control unit 40 of the inkjet recording apparatus 1 starts the machine, for example, when the power key or button is touched or pressed down.

After the machine starts, in a step S2, the control unit 40 of the inkjet recording apparatus 1 detects that the recording sheet 100 is set, and then rotates the registration roller 22 to form spike marks on the recording sheet 100 up to a reading position of the sensor 28. Then, in a step S3, the control unit 40 of the inkjet recording apparatus 1 executes the conveyance-amount correction sequence.

Subsequently, in a step S4, the control unit 40 of the inkjet recording apparatus 1 determines whether the amount of conveyance determined in the conveyance-amount correction sequence and the amount of skew are appropriate. When it is determined that those amounts are not appropriate ("NO" in the step S4), the recording sheet is reset and the conveyance-amount correction sequence is executed again. When it is determined that the determined amount of conveyance and the amount of skew are appropriate ("YES" in the step S4), in a step S5, the control unit 40 of the inkjet recording apparatus 1 starts the printing processes.

Figure 9:
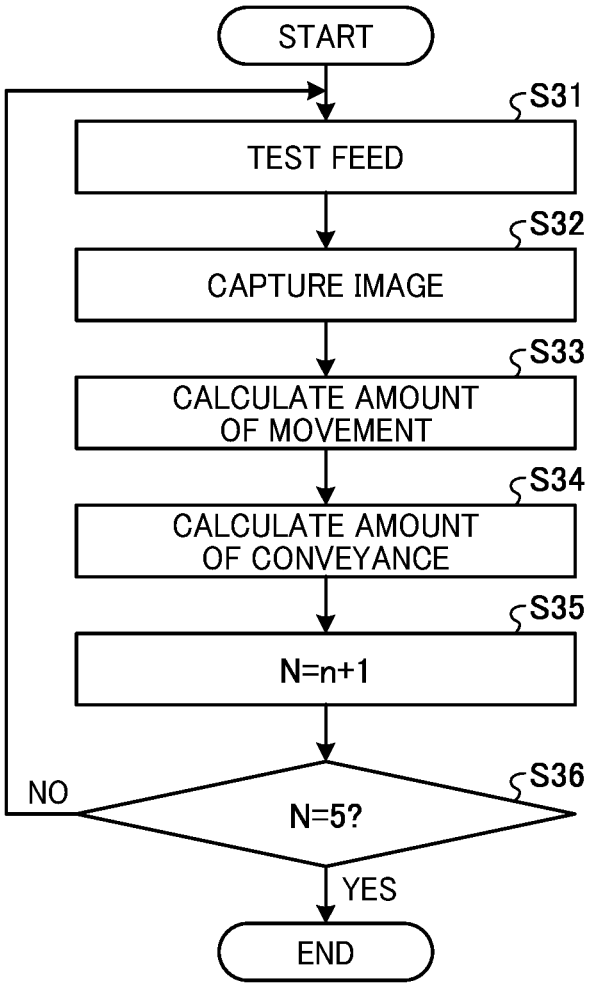
FIG. 9 is a detailed flowchart of the conveyance-amount correction sequence of FIG. 8.

FIG. 9 is a detailed flowchart of the conveyance-amount correction sequence of FIG. 8.

Firstly, in a step S31, the control unit 40 of the inkjet recording apparatus 1 starts an N-th test feed for the recording sheet 100, where N denotes 1 when the test feed is performed for the first time. Then, in a step S32, the control unit 40 of the inkjet recording apparatus 1 causes the sensor 28 to capture an image of the patterns of the spike marks 100-1 of the length indicated in the feed.

Subsequently, in a step S33, the control unit 40 of the inkjet recording apparatus 1 calculates the actual amount of movement based on the captured patterns, and in a step S34, calculates the actual amount of conveyance based on the calculated amount of movement.

Subsequently, in a step S35, the number of times N is incremented, and in a step S36, it is determined whether N has exceeded 5. When N does not exceed 5 ("NO" in the step S36), in a step S31, the test feed is performed again.

The amount of conveyance that is obtained in the conveyance-amount correction sequence performed five times is determined in the above steps. When N=6 and N exceeds N=5 ("YES" in the step S36), this series of processes is terminated. In the present embodiment, the upper limit of the number of times of conveyance N is set to 5. However, this is for the sake of explanatory convenience, and the number of times of conveyance is not limited to five times. The number of times of conveyance may be any desired number.

How the movement-amount calculation unit 403 calculates the amount of movement is described below.

Figure 10:
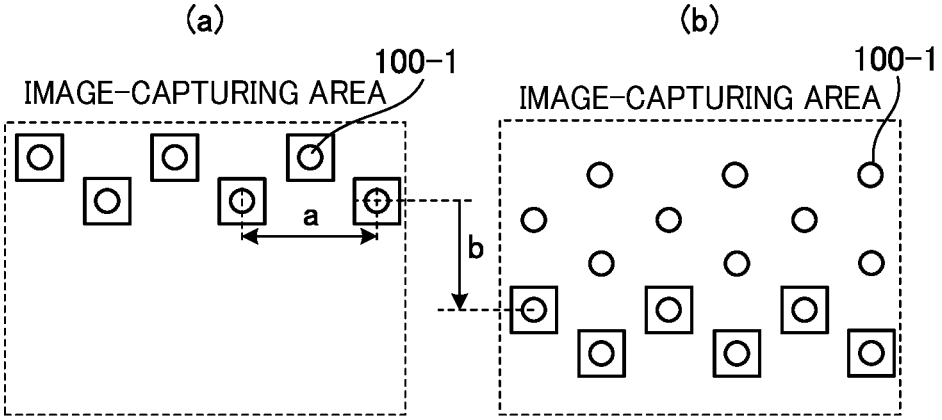
FIG. 10 is a diagram illustrating how the patterns of spike marks change in an image-capturing area, according to an embodiment of the present disclosure.

FIG. 10 is a diagram illustrating how the patterns of spike marks 100-1 change in the image-capturing area, according to the present embodiment.

FIG. 10 illustrates a pattern (a) of the spike marks 100-1 in the image-capturing area at a certain point in time and a pattern (b) of the spike marks 100-1 in the image-capturing area at the next point in time. The time interval between a certain time point and the next time point is a time interval to output an image captured by the sensor 28, which is set by the movement-amount calculation unit 403, and is, for example, a time interval at which the registration roller 22 is intermittently driven. At least two captured images are obtained at a time interval where the registration roller 22 is intermittently driven.

As illustrated in (a) and (b) of FIG. 10, the spike marks 100-1 of the same pattern are encompassed by rectangles. The movement-amount calculation unit 403 calculates the amount of movement of the pattern changed from (a) to (b) of FIG. 10 to obtain the actual amount of movement of the recording sheet 100.

If there is a variation in the distance between the recording sheet 100 and the sensor 28 due to an error in assembly of the sensor 28, the accuracy of detection could deteriorate. However, even if there is an error in assembly, the pitch a of the spikes 22-1 in the lateral direction is already known. For this reason, the amount of movement b of the multiple spikes 22-1 in the vertical direction can be calculated with reference to the pitch a of the multiple spikes 22-1 to detect the amount of movement of the recording sheet 100 with high accuracy.

Figure 11:
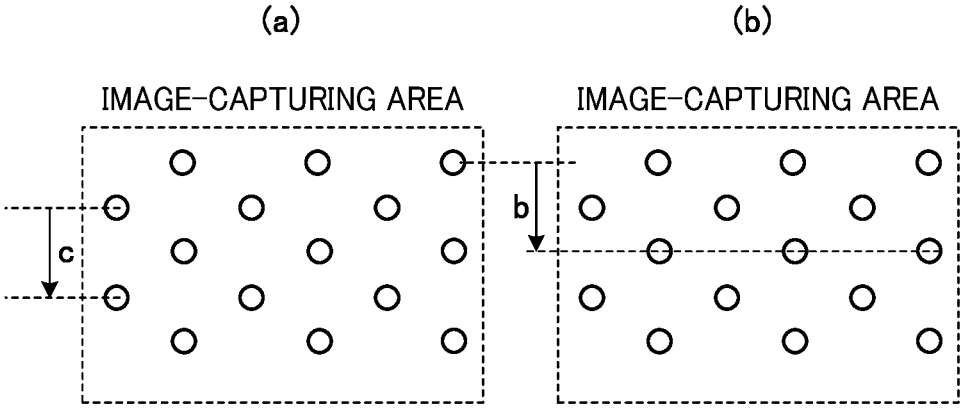
FIG. 11 is a diagram illustrating a pattern (a) in an image-capturing area at a certain point in time and a pattern (b) in the image-capturing area at the next point in time when the pitch of spike marks and the amount of conveyance of a recording sheet are equal to each other, according to an embodiment of the present disclosure.

FIG. 11 is a diagram illustrating a pattern (a) in the image-capturing area at a certain point in time and a pattern (b) in the image-capturing area at the next point in time when the pitch of the spike marks 100-1 and the amount of conveyance of the recording sheet 100 are equal to each other, according to the present embodiment.

In other words, in (a) of FIG. 11 and (b) of FIG. 11, a pitch c of the multiple spikes 22-1 is equal to the amount of conveyance b. When the pitch c of the multiple spikes 22-1 is equal to the amount of conveyance b as in the above, the pattern after the conveyance is equivalent to the pattern before the conveyance. For this reason, there may be some cases in which the actual amount of movement of the recording sheet 100 cannot correctly be detected. In order to handle such a situation, the amount of movement may be obtained as follows.

Figure 12:
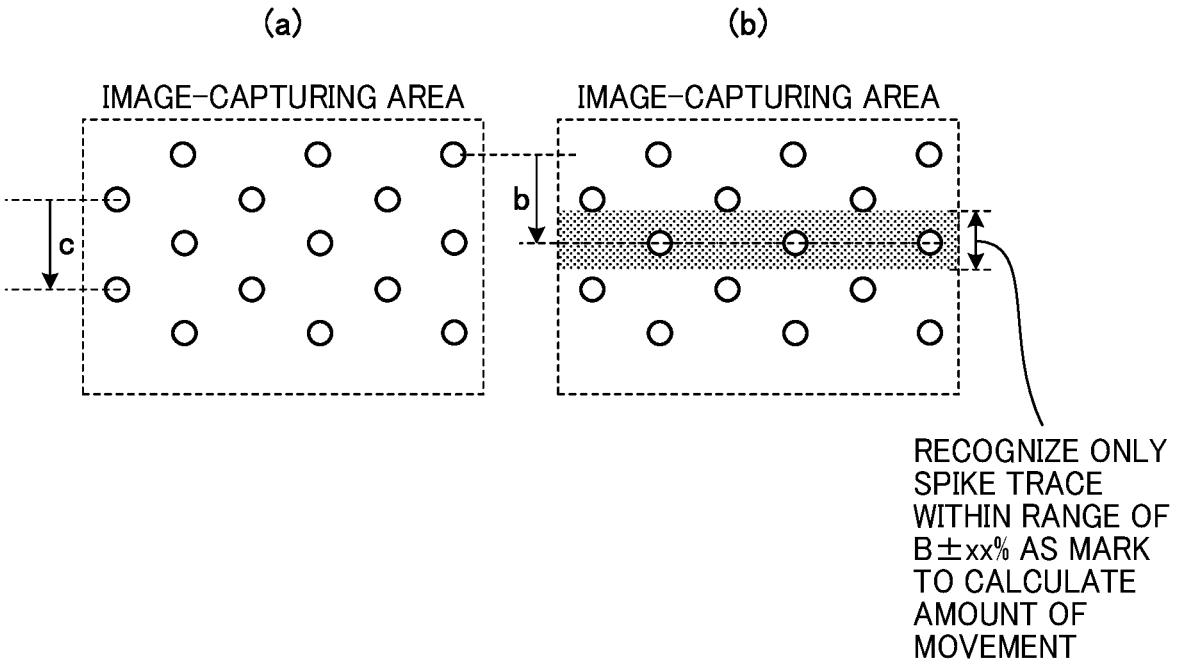
FIG. 12 is a diagram illustrating how the amount of movement is calculated and obtained, according to an embodiment of the present disclosure.

FIG. 12 is a diagram illustrating how the amount of movement is calculated and obtained, according to the present embodiment.

The movement-amount calculation unit 403 recognizes the amount of conveyance b in advance, and as illustrated in (b) of FIG. 12, the movement-amount calculation unit 403 captures an image near an area indicated by the amount of conveyance b with reference to (a) of FIG. 12. As a result, the amount of movement can be calculated. In such cases, an image is captured near an area indicated by the amount of conveyance b. For this reason, the amount of conveyance b can be shifted from the pitch c of the multiple spikes 22-1, and the amount of movement can be detected with high accuracy.

Figure 13:
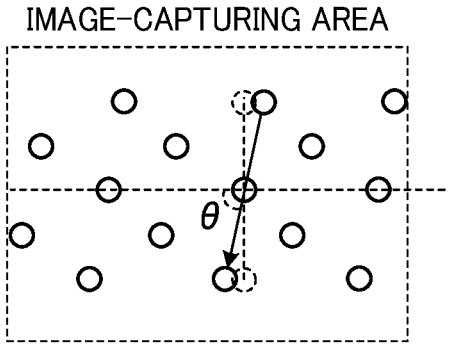
FIG. 13 is a diagram illustrating the detection of a skew or meandering on a recording sheet, according to an embodiment of the present disclosure.

FIG. 13 is a diagram illustrating the detection of a skew or meandering on the recording sheet 100, according to the present embodiment.

When a skew or meandering occurs on the recording sheet 100, some of the spike marks 100-1 move in a lateral direction. Accordingly, an angle θ is obtained for the spike marks 100-1 whose moving direction is indicated by an arrow as illustrated in FIG. 13 to detect a skew or meandering based on the amount of movement of the recording sheet 100 in the lateral direction.

Such a skew or meandering is detected in advance before printing is performed, and the recording sheet 100 is reset. By so doing, abnormal images can be prevented.

In the above embodiments of the present disclosure, the multiple spikes 22-1, which serve as markers that add a plurality of marks to the recording sheet 100 at even intervals, are arranged on the registration roller 22. However, no limitation is indicated thereby, and any other various kinds of methods may be adopted as long as markers that add a plurality of marks to the recording sheet 100 at even intervals are involved or implemented. For example, a plurality of orderly-arrayed marks may be transferred from the registration roller 22 with, for example, ink. Such a plurality of marks may be formed of, for example, ink that cannot be recognized by human eyes.

As described above, in the image forming apparatus according to the above embodiments of the present disclosure, the recording medium is marked when an image is formed on the recording medium. Due to such a configuration, even if the recording medium has no pattern, the amount of movement of the recording medium can be detected with high accuracy. As the recording medium is marked, a camera with high accuracy that is capable of capturing an image of a fiber pattern is not necessary, and the assembly is also easy. Further, in the above embodiments of the present disclosure, the amount of conveyance of the recording medium can be corrected together with the formation of an image. Accordingly, there are advantages in view of productivity and running cost.

The program to be executed by the image forming apparatus according to the above embodiments of the present disclosure may be installed for distribution in any desired computer-readable recording medium such as a compact disc, a read-only memory (CD-ROM), a flexible disk (FD), a compact disc-recordable (CD-R), and a digital versatile disk (DVD) in a file format installable or executable by a computer.

A program to be executed by the image forming apparatus according to the above embodiments of the present disclosure may be stored in a computer connected to a network such as the Internet, and may be downloaded through the network. Moreover, such a program that is executed by, for example, the image forming apparatus according to the above embodiments of the present disclosure may be provided or distributed through a network such as the Internet.

Alternatively, for distribution, various kinds of programs may be integrated in advance into, for example, a ROM inside the image forming apparatus according to the above embodiments of the present disclosure.

Note that numerous additional modifications and variations are possible in light of the above teachings. It is therefore to be understood that within the scope of the appended claims, the disclosure of the present disclosure may be practiced otherwise than as specifically described herein. For example, elements and/or features of different illustrative embodiments may be combined with each other and/or substituted for each other within the scope of this disclosure and appended claims.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An image forming apparatus comprising:

a conveyor configured to convey a recording medium based on a prescribed amount of conveyance;

an image forming device configured to form an image on the recording medium conveyed by the conveyor;

a marker configured to add a plurality of orderly-arrayed marks on the recording medium when the recording medium is conveyed by the conveyor;

a detector configured to detect the plurality of orderly-arrayed marks on the recording medium; and circuitry configured to:

calculate an amount of movement of the plurality of orderly-arrayed marks detected by the detector, and correct the prescribed amount of conveyance of the recording medium based on the amount of movement; and a roller configured to contact the recording medium and rotate as the recording medium is conveyed by the conveyor, wherein the marker is disposed on the roller.

2. The image forming apparatus according to claim 1, wherein the marker includes a plurality of protrusions disposed on a curved surface of the roller at equal distances, and is configured to contact the recording medium, and wherein the detector is configured to detect, on the recording medium, the plurality of orderly-arrayed marks formed by the plurality of protrusions.

3. The image forming apparatus according to claim 1, wherein the marker includes a plurality of protrusions and is configured to contact the recording medium, and wherein the detector is configured to detect, on the recording medium, the plurality of orderly-arrayed marks formed by the plurality of protrusions.

4. The image forming apparatus according to claim 1, wherein the circuitry is configured to calculate, as the amount of movement of the plurality of orderly-arrayed marks, an amount of movement of the plurality of orderly-arrayed marks in a vertical direction with reference to a pitch of the plurality of orderly-arrayed marks in a lateral direction detected on the recording medium.

5. The image forming apparatus according to claim 1, wherein the circuitry is configured to calculate an amount of movement of the plurality of orderly-arrayed marks detected on the recording medium in a lateral direction to detect a skew on the recording medium.

* * * * *